US007096646B2

(12) United States Patent
Schneider et al.

(10) Patent No.: US 7,096,646 B2
(45) **Date of Patent: *Aug. 29, 2006**

(54) FORM, FILL AND SEAL PACKAGING METHOD UTILIZING ZIPPER WITH SLIDER

(75) Inventors: John H. Schneider, Frankfort, IL (US); Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/968,488

(22) Filed: Oct. 19, 2004

(65) Prior Publication Data

US 2005/0050852 A1 Mar. 10, 2005

Related U.S. Application Data

(62) Division of application No. 09/961,823, filed on Sep. 24, 2001, now Pat. No. 6,804,935.

(51) Int. Cl.
*B65B 61/18* (2006.01)

(52) U.S. Cl. ..... 53/412; 53/133.4; 53/139.2; 53/450; 493/213; 493/927

(58) Field of Classification Search ..... 53/412, 53/410, 450, 550, 133.4, 139.2; 493/213, 493/927

See application file for complete search history.

(56) References Cited

U.S. PATENT DOCUMENTS 3,274,746 A * 9/1966 James et al. ..... 53/433
3,339,337 A * 9/1967 Rapp et al. ..... 53/562
4,663,915 A * 5/1987 Van Erden et al. ..... 53/450
4,876,842 A * 10/1989 Ausnit ..... 53/410
5,247,781 A * 9/1993 Runge ..... 53/412
5,282,349 A * 2/1994 Siegel ..... 53/433
5,358,334 A 10/1994 Simonsen
6,131,374 A 10/2000 Bois
6,138,439 A * 10/2000 McMahon et al. ..... 53/412

(Continued)

FOREIGN PATENT DOCUMENTS

EP 0 384 588 A2 8/1990

(Continued)

*Primary Examiner*—Louis K. Huynh
*Assistant Examiner*—Thanh Truong
(74) *Attorney, Agent, or Firm*—Pitney Hardin LLP

(57) ABSTRACT

A method of forming, filling and sealing a reclosable package with a slider activated zipper wherein a base film moves longitudinally to a filling station and, in a moving direction, away from said filling station. At the filling station a product is fed onto the base film. As the base film carrying product is moved from the filling station, a zipper with a slider attached is fed onto the moving film in the moving direction of the base film. The zipper has a first profile and a second profile, each of which has an attached web extending away from the slider. A top film is applied over the base film and the first profile web is sealed to the base film and the second profile web is sealed to the top film. The package is completed by transversely cross-sealing the base film and the top film together on opposite sides of the product. The base and top films may be formed from the same sheet folded over or may be formed from separate sheets.

2 Claims, 4 Drawing Sheets

U.S. PATENT DOCUMENTS

| | | | | |
|---|---|---|---|---|
| 6,178,722 | B1 | 1/2001 | McMahon | |
| 6,216,423 | B1 * | 4/2001 | Thieman | 53/412 |
| 6,290,393 | B1 * | 9/2001 | Tomic | 383/210.1 |
| 6,293,896 | B1 * | 9/2001 | Buchman | 493/213 |
| 6,327,754 | B1 * | 12/2001 | Belmont et al. | 24/400 |
| 6,327,837 | B1 * | 12/2001 | Van Erden | 53/412 |
| 6,427,421 | B1 * | 8/2002 | Belmont et al. | 53/412 |
| 6,588,176 | B1 * | 7/2003 | Buchman | 53/412 |
| 6,871,473 | B1 * | 3/2005 | Dutt et al. | 53/133.4 |
| 2001/0045083 | A1 | 11/2001 | McMahon et al. | |
| 2002/0015537 | A1 | 2/2002 | Strand et al. | |
| 2003/0145558 | A1 * | 8/2003 | Schneider et al. | 53/412 |

FOREIGN PATENT DOCUMENTS

| | | | |
|---|---|---|---|
| EP | 0 384 588 | A3 | 7/1991 |
| EP | 0 524 359 | A2 | 1/1993 |
| EP | 0 524 359 | A3 | 2/1993 |
| EP | 1 026 077 | A2 | 8/2000 |
| EP | 1 026 077 | A3 | 10/2001 |
| EP | 1 223 111 | A2 | 7/2002 |
| EP | 1 223 111 | A3 | 5/2003 |

* cited by examiner

SLIDER LOADING STATION
PRODUCT

FORM, FILL AND SEAL PACKAGING METHOD UTILIZING ZIPPER WITH SLIDER

This application is a divisional of U.S. patent application Ser. No. 09/961,823, filed on Sep. 24, 2001, now U.S. Pat. No. 6,804,935.

BACKGROUND OF THE INVENTION

The present invention relates to packaging and, in particular to the manufacture of slider zipper packaging on a horizontal form, fill and seal (FFS) machine.

Packaging with zippers has become increasingly popular as the primary packaging for a wide variety of goods, and, in particular for food products. Such zippers may be operated simply by pressing the profiles together or pulling them apart to close and open the zipper or by moving a slider along the zipper profiles to engage and disengage the zipper profiles. Slider activated zippers are becoming increasingly popular for primary packaging, perhaps because they impart to the consumer the perception of a more securely closed package and ease of operation. The addition of a slider to the zipper package makes it more difficult to assemble the package particularly if relatively high speed, automated equipment is to be used to form, fill and seal the package as is quite common in the food industry.

SUMMARY OF THE INVENTION

The present invention provides a method of forming, filling and sealing a reclosable package with a slider activated zipper. The method comprises moving a base film longitudinally (i.e. in the running direction of the film) to a filling station and, in a moving direction, away from said filling station. At the filling station a product is fed onto the base film. As the base film carrying product is moved from the filling station, a zipper with a slider attached thereto is fed onto the moving film in the moving direction of the base film. The zipper has a first profile and a second profile, each of which has a web attached thereto extending away from the slider. A top film is then applied over the base film and the first profile web is sealed to the base film and the second profile web is sealed to the top film. The package is completed by cross-sealing the base film and the top film together on opposite sides of the product, capturing said product between adjacent cross seals and transversely cutting the sealed together base film and top film.

The top and base films may be formed from the same sheet in which case the package top or bottom or one side would be formed as a longitudinal fold line that separates the top and bottom films. Alternatively, the top and bottom films may be separate films in which case a bottom seal would have to be formed opposite the zipper joining the top and base films together. If separate films, the base film may be a thermoform film which can be formed into adjacent product receptacles.

The slider is attached to the zipper as the zipper moves to the base film. To this end, as the zipper moves to the film, the zipper is stomped or shaped at bag length intervals to retain the slider on the zipper and a slider is attached to the zipper between adjacent stompings. After the zipper is attached to the base film the profiles are further stomped or shaped to aid in allowing the package to make a hermetic seal.

DETAILED DESCRIPTION OF THE PREFERRED EMBODIMENTS

Figures 1, 2, 3, 4, 5:
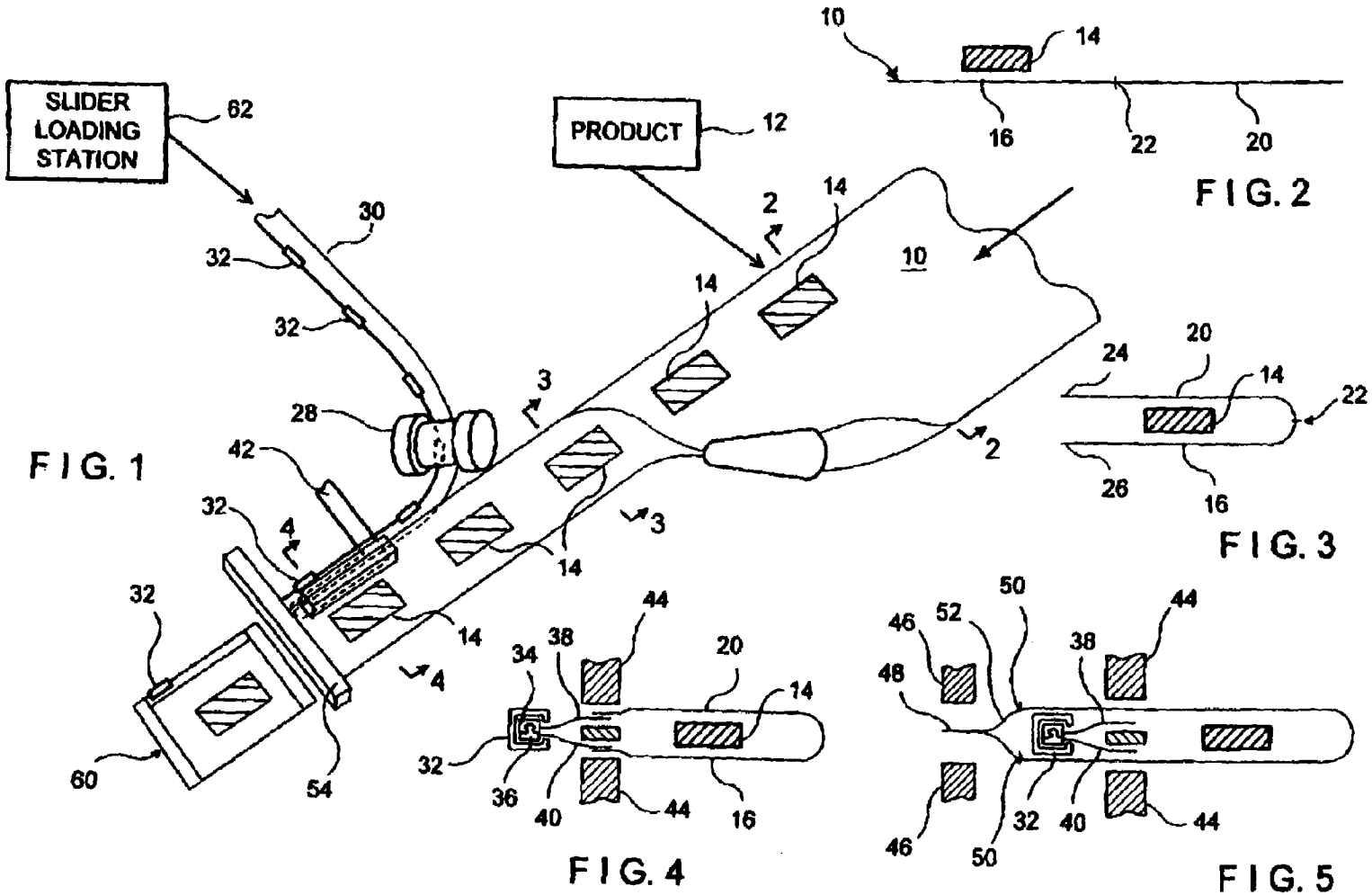
FIG. 1 is a schematic perspective view of a first embodiment of the method in accordance with the present invention.
FIG. 2 is a sectional view taken along reference lines 2—2 of FIG. 1.
FIG. 3 is a sectional view taken along reference lines 3—3 of FIG. 1.
FIG. 4 is a sectional view taken along reference lines 4—4 of FIG. 1.
FIG. 5 is a view similar to FIG. 4 showing an alternative bag top construction.

Reference is now made to the drawings wherein several embodiments and modifications of the present invention are depicted. In FIG. 1 a film 10 whose width is roughly twice the depth of a desired package is horizontally drawn by an appropriate drive past a product filling station 12 from which a product 14 is loaded onto the film 10 at longitudinally spaced intervals. The product 14 is loaded onto the approximate center of a first half 16 of the film 10 as shown in FIG. 2. As the film 10 carrying product continues to move it is longitudinally folded along fold line 22 by guide 18 so that the second half 20 of film 10 folds over the first half 16 sandwiching the product 14 between a base film defined by film half 16 and a top film defined by second film half 20, as shown in FIG. 3. As may also be seen in FIG. 3, the free edges 24 and 26 of the top and bottom films are generally aligned with each other.

The product carrying folded film is then moved past a zipper drive 28 which feeds a zipper 30 having pre-attached sliders 32 between the edges 24 and 26 of the top and bottom sheets. The zipper drive includes a grooved roller arranged at 45° to the film and the zipper to guide the zipper to the film. The zipper 30 has interlocking profiles 34, 36 which are stomped together at bag length intervals and a slider 32 is provided between each adjacent pair of stomps. The stomps serve as end stops to prevent the sliders from running from one section of the zipper to the next. Each of the zipper profiles has a web, 38, 40 that extends away from the slider and the zipper drive 28 feeds the zipper 30 so that the webs 38 and 40 are on opposite sides of separator 42 as shown in FIG. 4. As also shown in FIG. 4, heated seal bars 44 close against the separator 42 to seal zipper flange 38 to the edge of top film 20 and to seal zipper flange 40 to the edge of bottom film 16. This arrangement leaves the slider 32 outside the packaging film envelope.

In a modification shown in FIG. 5 the profile webs 38 and 40 are spaced somewhat from the free edges 24, 26 of the base and top films. The free edges 24, 26 are then sealed to each other along seal line 48 by sealing bars 46 thereby capturing the slider within a header 52 inside the package envelope. The header provides tamper evidence for the final package since it must be removed by the consumer to gain entry to the package. To facilitate removing the header 52 between the seal line 48 and slider top, weakening lines 50, such as score lines or perforations are provided below the seal line 48.

The film envelope is then moved past cross sealer/cutter bars 54 which form transverse seals (i.e. perpendicular to the running direction of the film) at bag length intervals and cut through the seals thereby releasing a filled package 60 with product contained therein.

Figure 7A:
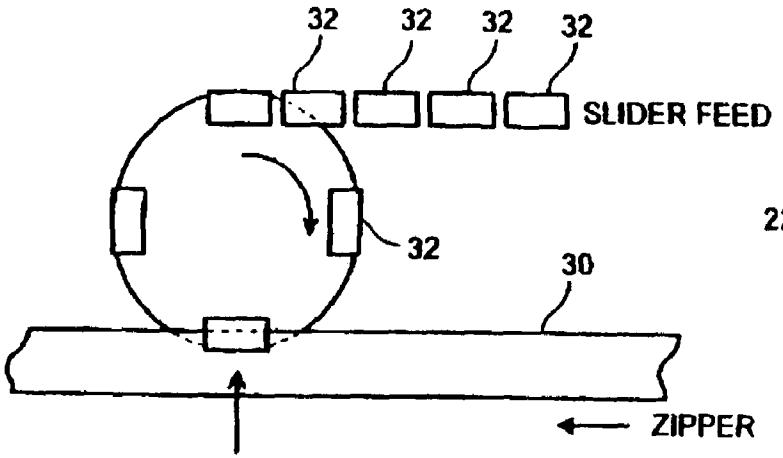
FIG. 7*a* is a top plan view of a second alternative slider attaching system.
Figure 6:
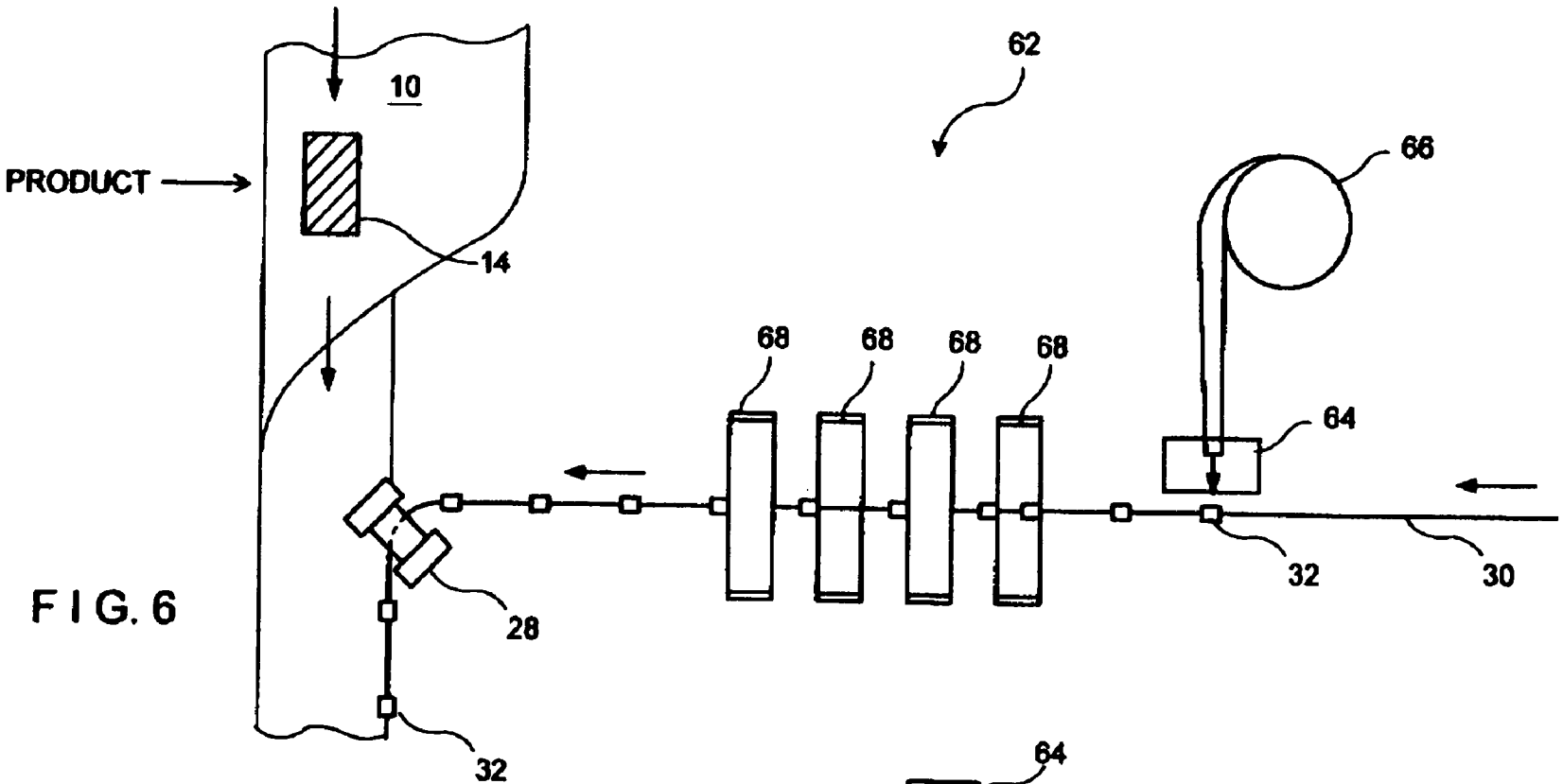
FIG. 6 is a top plan view of a first embodiment of a slider attaching system.
Figure 7:
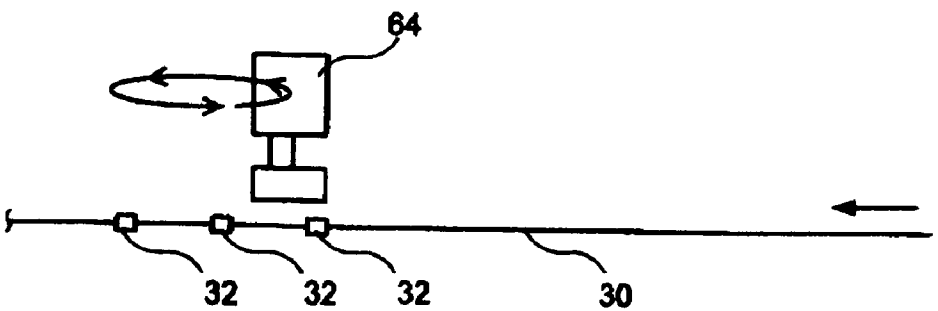
FIG. 7 is a top plan view of a first alternative slider attaching system.

The sliders 32 are loaded onto zipper 30 at a zipper loading station 62. In FIG. 6 a first embodiment of zipper loading station 62 is depicted. As shown, zipper 30 is intermittently drawn to a zipper loading station 64 where a slider 32 fed from a vibratory bowl 66 is attached to the zipper profiles. The sliders are attached at bag length intervals of zipper. The zipper with attached sliders is then intermittently moved into a series of dancer roll 66 and then continuously drawn from the dancer roll system by the zipper drive 28 and fed to the package film. In FIG. 7 a first modification of the zipper attaching system is depicted wherein the zipper loading station reciprocates as it applies a slider 32 to the zipper 30 thus eliminating the stop-go action of the first embodiment and the need for dancer rolls. In FIG. 7*a* a second embodiment of the zipper attaching system is depicted wherein the zipper loading station rotates between a first location at which it receives a slider 32 and a second location at which the slider is attached to the zipper. This arrangement eliminates the stop-go action of the first embodiment as well as the reciprocating action of the second embodiment.

In each of the embodiments, either prior to attachment of the slider onto the zipper or after the slider is attached, the zipper is stomped at bag length intervals, with a slider positioned between each pair of stomps.

Figure 5A:
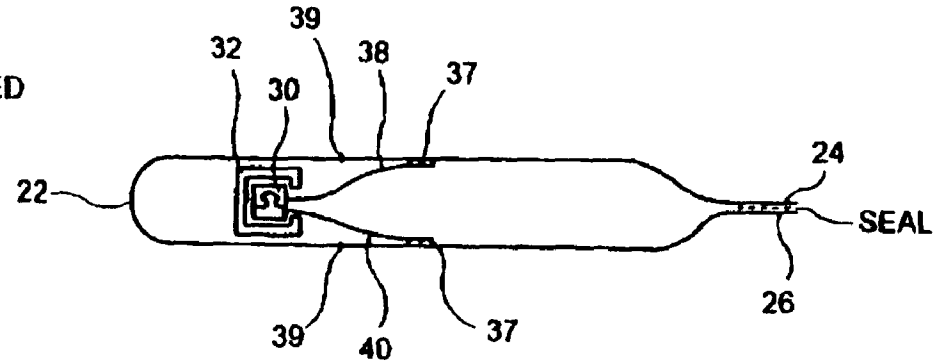
FIG. 5*a* is a further modification of the bag top construction.

In a further modification depicted in FIG. 5*a* the fold line 22 forms the top of the package and the longitudinal edges 24, 26 are sealed to form the package bottom. In this case the zipper 30 with attached slider 32 is positioned within fold 22 and the webs 38, 40 are attached to opposite sides of the fold at seals 37. Tear lines 39 are provided between the fold 22 and seals 37 to permit the top of the bag to be easily removed to provide access to the zipper.

Figure 8:
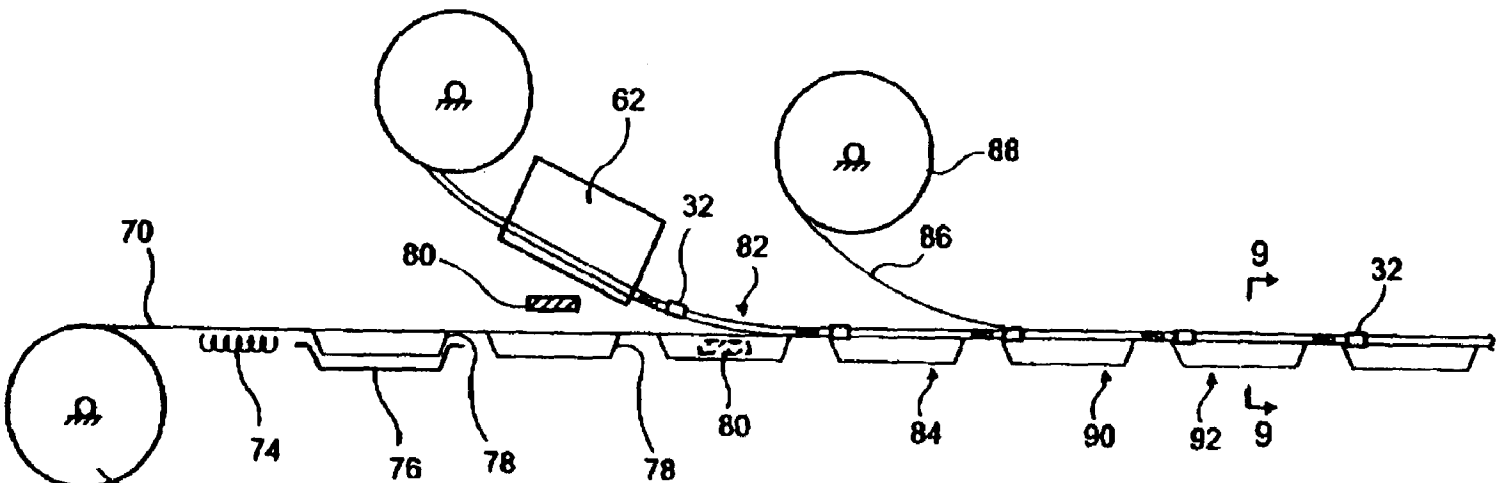
FIG. 8 is a schematic side elevational view of a second embodiment of the method in accordance with the present invention.

Reference is now made to FIG. 8 wherein a second embodiment of the present invention is schematically depicted. In accordance with this embodiment the top and bottom films are provided as separate webs. The base web 70 is drawn from roll 72 and comprises a thermoform material. At a first station 74, the base web is heated and conditioned to be formed. At the forming station 76, the heated material is drawn to form a tray or receptacle 78 into which a product 80 is deposited at filling station 82. A continuous, pre-stomped zipper 30 with attached sliders 32 is then fed from the slider loading station 62 to an edge of the base film and aligned so that a zipper section between adjacent stomps containing a slider extends along the base film edge adjacent each receptacle. A bottom web of the zipper (i.e. the web that rests on the base film) is then sealed to the base film and the slider is moved to the zipper fully closed position at station 84. A top film 86 is then fed from spool 88 and at station 90 the top film is sealed to the other web of the zipper. The zipper may then be crimped at the stomps to ensure the slider remaining on the zipper between the stomps and to facilitate making a side seal through the zipper. That is, by flattening the ends of the zipper, more secure cross seals can be made. At station 92 air is evacuated from the tray (if a hermetic package is required) and perimeter seals are formed about the tray. The filled package 94 is then severed from the web.

To open the package for the first time, the top seal 95 is ruptured and the slider 92 is moved to the open position. To this end, a peel seal material may be provided as the top portion of the perimeter seal. In the case of the FIG. 9 embodiment the top portion of the bag is torn off along tear lines 39. The product 80 can then be removed and thereafter, the package 94 can be reclosed (but not re-sealed) using the slider 32 to open and close the zipper 30.

Figure 9:
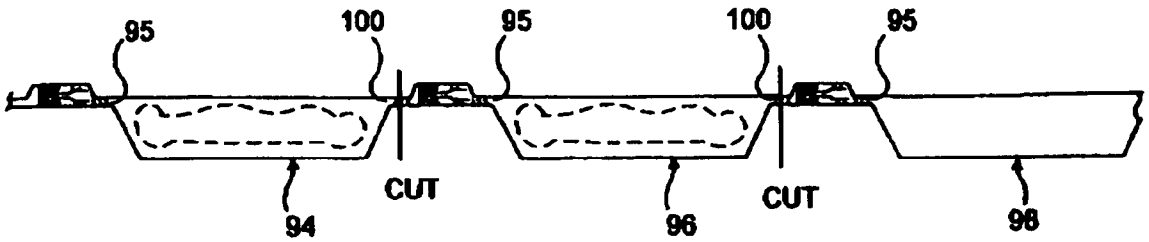
FIG. 9 is a sectional view along lines 9—9 of FIG. 8.

Multiple packages may be formed side-by side as shown in FIG. 9 by using a wide film and two or more zippers. In such case, each package must be separated from the tranversely adjacent package by cutting through the bottom seal 100 outboard of the adjacent package zipper. That is, a cut is made through bottom seal 100 of package 94 to maintain a bottom seal for package 94 while freeing package 94 from adjacent package 96 and permitting access to the slider of package 96. Similarly a cut is made through the bottom seal 100 of package 96 freeing package 96 from adjacent package 98 and permitting access to the slider of package 98.

Figure 11:
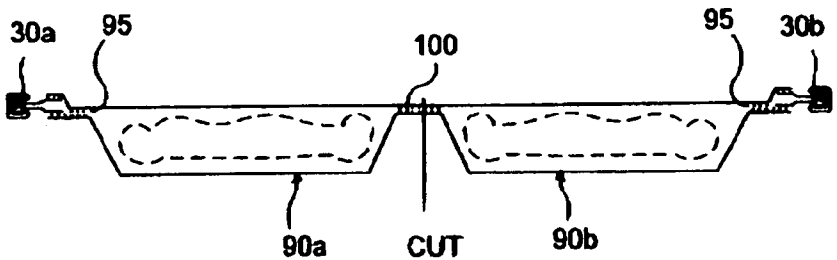
FIG. 11 is a sectional view of a modification of the embodiment of FIG. 9.
Figure 10:
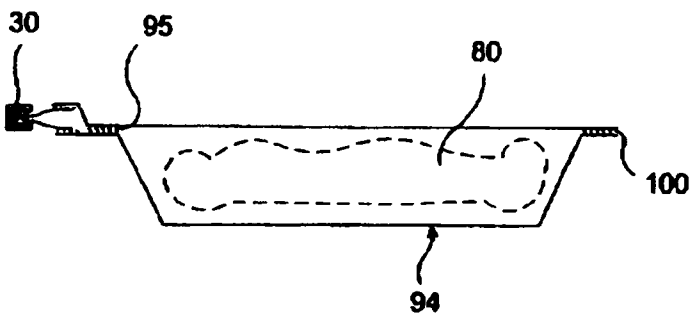
FIG. 10 is a side elevational view of a package formed in accordance with the method of FIG. 8.

Thus in accordance with the above the aforementioned objectives are effectively attained. Those skilled in the art will appreciate that variants of the described embodiments may readily be practiced. For example, two rows of trays of packages may be formed bottom-to-bottom as shown in FIG. 11 rather than top-to-bottom as described above. In this case the second zipper 30*b* would be positioned two package depths from the first zipper 30*a* and the packages 90*a* and 90*b* would be separated by cutting through the common bottom seal 100. Also, the slider for the tray packages may be contained within a header as described for the flat packages of the first embodiment by placing the zipper inward of the film edges and then joining the film edges.

Having thus described the invention, what is claimed is:

1. A method of forming, filling and sealing a reclosable package comprising:

moving a base film to a filling station and, in a moving direction, away from said filling station;

depositing a first product onto said base film at the filling station;

feeding a first zipper with a slider attached thereto in the moving direction onto said base film; said zipper having a first profile and a second profile engageable with said first profile, each of said profiles having a web attached thereto extending away from said slider;

after said step of depositing, applying a top film over said base film and said first product;

sealing said first profile web to said base film and said second profile web to said top film;

cross-sealing said base film and said top film together in a direction transverse to the moving direction of the base film on opposite sides of said product, capturing said product between adjacent cross seals; and transversely cutting said sealed together base film and top film on said opposite sides of said product;

wherein said base film and top film comprise substantially equal adjacent sections of a common sheet having opposed longitudinal edges and comprising the further step of folding said common sheet longitudinally substantially at a midpoint of said common sheet between said edges to position said top film over said base film; and wherein said zipper is positioned within said fold and comprising the further step of sealing together said opposed longitudinal edges to form a bottom for said package, said opposed longitudinal edges being opposite to said fold.

2. An apparatus for forming, filling and sealing a reclosable package comprising:

a first drive for moving a base film to a filling station and, in a moving direction, away from said filling station;

a filling station for depositing product onto said base film;

a second drive for feeding a first zipper with a slider attached thereto in the moving direction onto said base film; said zipper having a first profile and a second profile engageable with said first profile, each of said profiles having a web attached thereto extending away from said slider;

means for applying a top film over said base film and said product downstream of said filling station;

first sealing means for sealing said first profile web to said base film;

second sealing means for said second profile web to said top film;

cross-sealing means for sealing said base film and said top film together in a direction transverse to the moving direction of the base film on opposite sides of said product, capturing said product between adjacent cross seals;

a cutter for transversely cutting said sealed together base film and top film on said opposite sides of said product;

wherein said base film and top film comprise substantially equal adjacent sections of a common sheet and further comprising means for folding said common sheet longitudinally substantially at a midpoint of said common sheet and to position said top film over said base film; and wherein said zipper is positioned within said fold and further comprising means sealing together said opposed longitudinal edges to form a bottom for said package, said opposed longitudinal edges being opposite to said fold.

* * * * *